US005482405A

United States Patent [19]

Tolksdorf et al.

[11] Patent Number: 5,482,405

[45] Date of Patent: Jan. 9, 1996

[54] COUNTERBALANCING DEVICE FOR DIVERS

[76] Inventors: Michael Tolksdorf; Thomas Tolksdorf, both of Hertzlerstrasse 29, W-4300, Essen, Germany

[21] Appl. No.: 75,458

[22] PCT Filed: Jan. 25, 1992

[86] PCT No.: PCT/EP92/00164

§ 371 Date: Jun. 11, 1993

§ 102(e) Date: Jun. 11, 1993

[87] PCT Pub. No.: WO92/13756

PCT Pub. Date: Aug. 20, 1992

[30] Foreign Application Priority Data

Jan. 30, 1991 [DE] Germany ..... 41 02 622.5
Jan. 4, 1992 [DE] Germany ..... 42 00 090

[51] Int. Cl.[6] ..... B63C 11/08

[52] U.S. Cl. ..... 405/186; 405/185

[58] Field of Search ..... 405/185, 186, 405/187; 114/331, 334; 441/88, 89, 90, 92, 96

[56] References Cited

U.S. PATENT DOCUMENTS 3,487,647 1/1970 Brecht, Jr. .

FOREIGN PATENT DOCUMENTS

0041191A1 12/1981 European Pat. Off. .
1557300 2/1969 France .
3644742 7/1987 Germany .
2126534A 3/1984 United Kingdom .
WO88/05670 8/1988 WIPO .

*Primary Examiner*—David H. Corbin
*Attorney, Agent, or Firm*—Spencer, Frank & Schneider

[57] ABSTRACT

A counterbalancing device and method for a diver for automatically diving, surfacing or floating at a predetermined water depth including a control element for setting the predetermined water depth, a pressure sensor for measuring a water depth of the diver, an electronic control unit for determining a rate of descent and a rate of ascent based on a change of the measured water depth over time, such that the electronic control unit controls at least one valve for one of filling air into and releasing air from at least one life jacket associated with the diver for controlling the diver's rate of ascent and descent, respectively, as a function of a difference between the determined rate of ascent or descent and a predetermined rate of ascent and descent, respectively, until the predetermined water depth is attained.

26 Claims, 3 Drawing Sheets

COUNTERBALANCING DEVICE FOR DIVERS

BACKGROUND OF THE INVENTION

1. Field of the Invention

The invention relates to a method for operating a counterbalancing device for a diver automatically to dive, surface or float at a prescribed or preselectable water depth.

2. Description of the Related Art

When scuba diving, that is to say using compressed air tanks, buoyancy compensator and life jacket, regulator and other items of equipment, in underwater sport the diver has to set valves manually by hand operation in order to dive, surface and float at a specific water depth. To this end, the diver weights himself down before the dive using a weight belt having lead, as required, in order to ensure that it is possible to dive. After the diver has reached the desired water depth, he fills his buoyancy compensator and life jacket via valves with air from the compressed air tank until he is floating in the water. This state is achieved when the weight of the water displaced by the diver together with his equipment is exactly as large as the weight of the scuba diver.

This setting of the desired water depth is known as counterbalancing. Counterbalancing is one of the most important diving skills, which a diver must master, in particular, in order to be able to protect himself against damage to his health, but also in order to be able to save energy underwater and to dive pleasurably. The counterbalancing operation is relatively difficult, because there is a time delay between operating the valve to fill or empty the buoyancy compensator and life jacket and the change in depth, and because, as a consequence of a change in depth due to swimming movements or water currents, the air volume in the jacket automatically changes precisely to further to amplify the positive or negative buoyancy.

A particularly critical case is surfacing, since the air in the jacket expands because of dropping water pressure, and consequently the positive buoyancy becomes ever larger. In the event of an excessively rapid and uncontrolled ascent, the danger exists of a decompression injury or of tearing of the lung.

A device for automatically limiting the rate of ascent in the case of surfacing by divers is to be taken from EP-A 41194. The device is characterized by a chamber that is connected to the interior of the life jackets and has, subdividing it, an elastically longitudinally movable, sealing partition which is connected to a valve closing part which is displaceable in a sealing manner and leads outwards and whose associated valve seat is arranged in the outer wall of the life jacket, the chamber sections formed by the partition being connected to one another by a dosing nozzle and a check valve that is open in the direction towards the closed chamber section.

A diving positive buoyancy compensator, in particular in the form of a buoyancy compensator or counterbalancing jacket for positive buoyancy compensation or stabilization and for emergency flotation of a diver during diving, can be taken from DE-A 3,644,742. The counterbalancing jacket cooperates with a safety valve arrangement which has an operating mechanism for opening a valve, the mechanism being provided with a drag line by means of which the diver can manipulate the mechanism. The drag line extends from the operating mechanism through the first inflation hose, which can be expanded and contracted in the manner of a bellows, to the inflator, which is arranged at the end of the hose. The safety valve arrangement has, moreover, effective means for sealing against water.

As a consequence of the purely mechanical operation of the counterbalancing devices, the rates of ascent and descent cannot be variably set, so that the ascent and descent cannot be optimally controlled for the diver. These devices may well be capable of rendering assistance to the diver during ascent, but they are not suitable for keeping constant a state of floating at a prescribed water depth.

SUMMARY OF THE INVENTION

The aim on which the subject matter of the invention is based is to be seen, on the one hand, in automatically realizing diving and surfacing at a rate that is acceptable to the diver and, on the other hand, in keeping the diver, likewise in an automatic fashion, at a prescribed or preselectable water depth without there being a need for continuous manual readjustment of the counterbalancing device.

This aim is achieved according to the invention when the desired water depth is set on a control element, a pressure sensor measures the instantaneous water depth and makes the measured values available to an electronic control unit which determines the necessary diving depth as well as the rates of descent and ascent and, on the basis of the values determined, the electronic control unit controls at least one valve in such a way that, depending on the requirement, air is filled into or let out of at least one life jacket provided in the region of the body of the diver.

A device for a diver automatically to dive, surface or float at a prescribed or preselectable water depth according to the invention is characterized by at least one electronic control unit for controlling the valve, which is connected to at least one pressure sensor.

Also is the use of a counterbalancing device, consisting of an electronic control unit, at least one valve, at least one pressure sensor and electrical components for a scuba diver to automatically dive, surface or float at a prescribed or preselectable water depth.

The advantages achieved by means of the subject matter of the invention consist, in particular, in that diving is substantially simplified and safety is increased, since the depth at which it is desired to dive is automatically monitored and controlled, as a result of which diving at undesired depths can be reliably avoided. In addition, the rates of descent and ascent are limited in order to avoid consequences damaging to health. It is possible to set and keep preselected water depths in a controlled fashion so accurately that activities underwater, for example tasks carried out by professional divers, are simpler to perform than previously.

The rates of descent and ascent can be set variably in permissible ranges, the electronic unit controlling the descent or ascent as long as a switch is operated by the diver. Subsequently, the associated water depth is determined and stored, the diver then being kept with the aid of the electronic control unit constantly at the depth, which is either prescribed or preselected in advance by the diver.

A rate control loop is preferably superimposed on the depth or pressure position control loop, resulting in a further safety measure. The superimposed rate control loop also remains ,active at the water depth achieved, the desired value for the rate control loop having its magnitudes set on the electronic control unit. Consequently, in the event of a correct rate of descent or ascent, the rate control loop exerts no influence on the depth or pressure position control loop, that is to say it is in stand-by position.

With regard to the safety of the diver underwater, it is, furthermore, proposed that if the system deviation does not decrease in the event of an activated electronic control unit, the diver is warned and the electronic control unit is switched off, so that the diver can again counterbalance manually for safe ascent.

The parameters on which the diving operation is based with the aid of an automatic counterbalancing device, such as the desired value, the system deviation, rate of descent or ascent, actual value and the respective operating state (possible emergency situation) are continuously displayed on a display. The position of the valve or valves is preferably monitored by limit Switches. Moreover, failures of the pressure sensor, cable breaks and the capacity of the power supply device are monitored, the warning for the diver being carried out automatically, for example, acoustically, or switching off the electronic control unit being performed automatically.

For people who are not yet so familiar with diving or who would much like to learn diving, the electronic control unit is set to the effect that the change in the previously set maximum water depth is locked by a timing circuit for the duration of the dive, so that here no unintended intervention can be performed by the diver.

Before each dive, for reasons of safety the electronic control unit carries out a self test in which all the functions are checked and the result is displayed on the display.

By contrast with the indicated prior art, in the case, for example, of overshooting of the permissible diving time, or threats of damage to health, or of an insufficient quantity of air for continuing the dive, the electronic control unit automatically initiates the surfacing operation.

The electronic control unit can be arranged in the region of the life jacket, it being possible for any other point on the body of the diver or on further items of equipment likewise to be provided for this purpose. The same holds for the pressure sensor or the valve or valves.

The electronic control unit can be constructed on the basis of a microprocessor or on an analog basis. The same holds for the valves, which are designed to function both discontinuously and continuously, it being possible to use both pressure valves and directional control valves.

BRIEF DESCRIPTION OF THE DRAWINGS

The invention is represented in the drawing with the aid of an exemplary embodiment and described as follows.

DETAILED DESCRIPTION OF THE PREFERRED EMBODIMENTS

Figure 1:
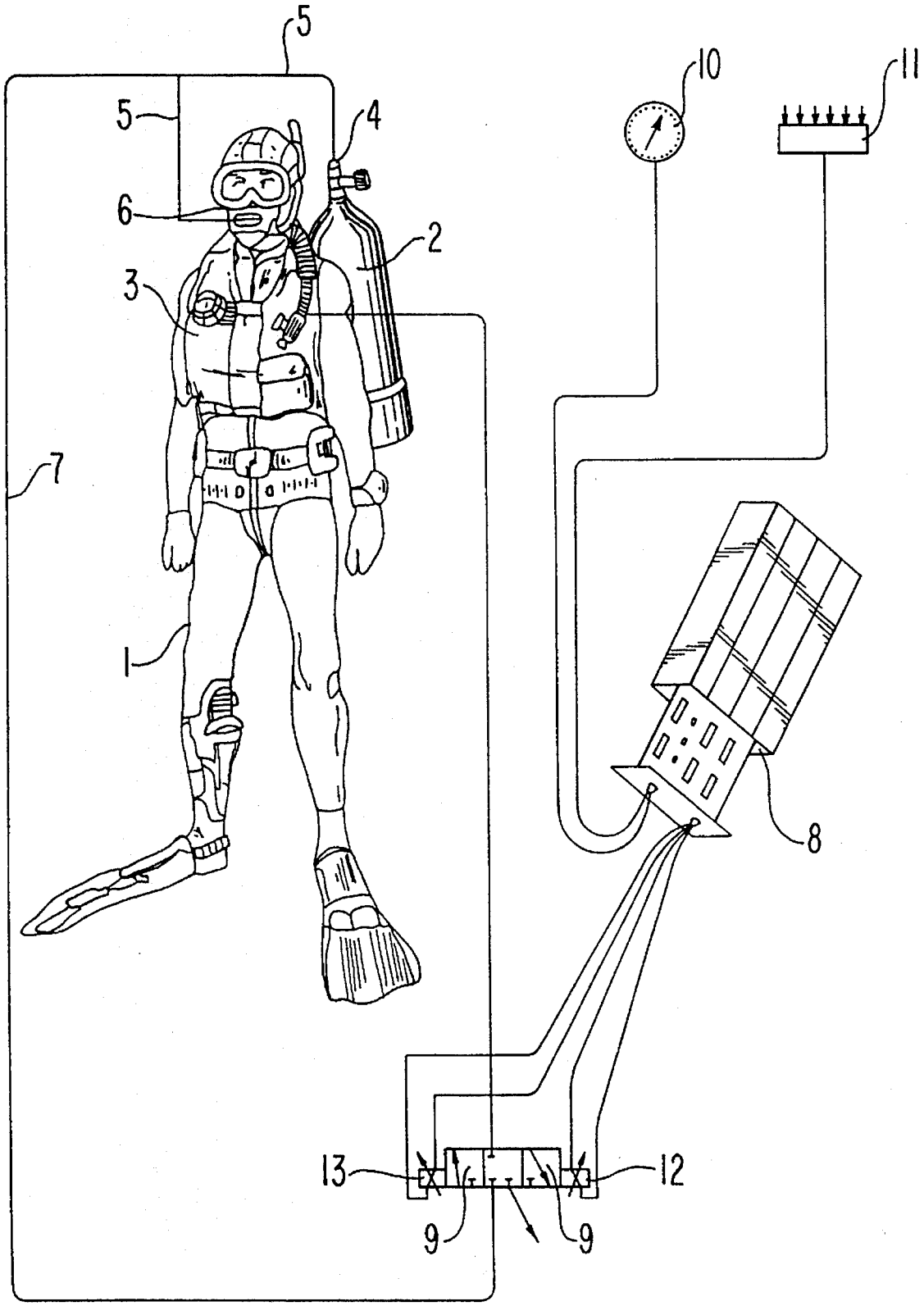
FIG. 1 shows a diver with a compressed air tank and life jacket, as well as a diagrammatic representation of the function of the automatic counterbalancing device.

FIG. 1 shows a diver 1 who is equipped with a compressed air tank 2 and a life jacket 3. The compressed air tank 2 is provided with a pressure reducing valve 4. The hose 5 joined hereto leads, on the one hand, to the regulator 6 and, on the other hand, in the manner of a bypass 7 to the life jacket 3. The automatic counter-balancing device 8 is formed by an electronic control unit, which is constructed in this example on the basis of a microprocessor. The electronic control unit 8 controls a valve 9, in this example an electropneumatic directional control valve. Furthermore, a control element 10 is provided in the form of a desired-value potentiometer, as is a pressure sensor 11, both of which are operationally connected to the electronic control unit 8.

The diver 1 preselects a water depth on the desired-value potentiometer 10, and the instantaneous water depth is measured by the pressure sensor 11, proceeding from the fact that the hydrostatic pressure and the water depth are directly proportional to one another ($p=g \times rho \times h$, where $g=9.8\ m/s^2$, rho=density and h=water depth).

The pressure sensor 11 transforms the pressure into an electronic variable which is further processed by the electronic control unit 8, and compares the setting of the desired-value potentiometer 10 with the actual value of the pressure or with the water depth. If the diver 1 is located above the set desired value, for example at the surface of the water, the electronic control unit 8 computes a system deviation and operates the magnet 12 of the valve 9', which lets air out of the life jacket 3 of the diver 1 so that the latter descends until the set water depth is achieved and the valve 9 closes. If the diver 1 is located deeper than the preselected value, the sign of the system difference changes and the other magnet 13 of the valve 9 is controlled until air is let into the life jacket 3, and the diver 1 ascends until the set value is achieved and the valve 9 closes on the basis of the system deviation of 0.

A rate control loop is superimposed on this position control loop, so that the difference in depth is measured over time, and thus the rate of descent or ascent is determined ($v=ds/dt$, where d is the difference, s the distance and t the time) and set as a matter of priority in such a way that they are safe and pleasant for the diver 1.

Figure 2:
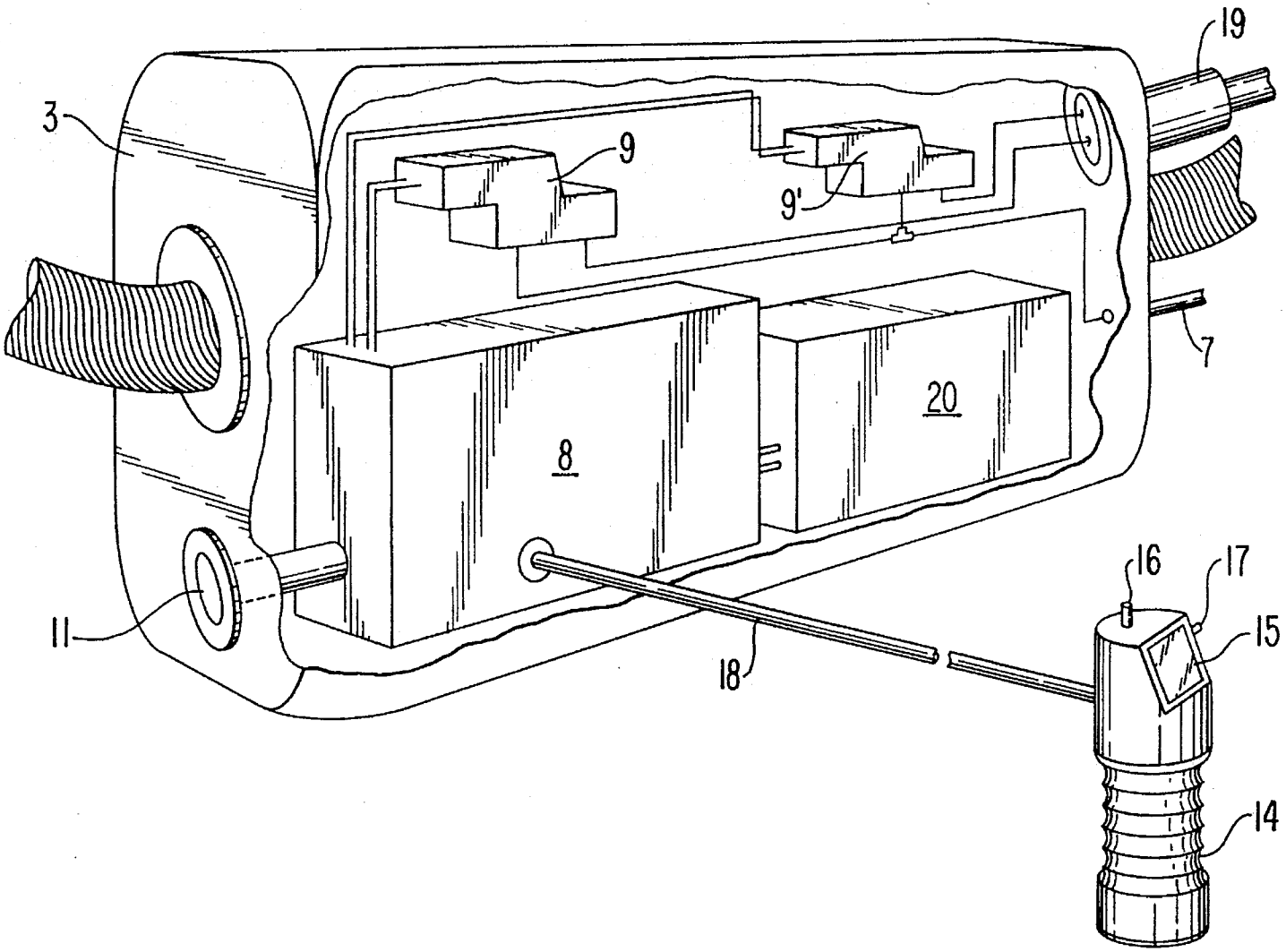
FIG. 2 shows a detail of the life jacket together with the automatic counterbalancing device.

FIG. 2 shows the life jacket 3 as a detailed representation. Provided on the one hand in the region of the life jacket 3 are the electronic control unit 8, two valves 9, 9' and the pressure sensor 11. Connected to the electronic control unit 8 is a finger-like element, or joystick 14 which is to be operated by the diver 1 and has, on the one hand, a display 15 and, on the other hand, alternatively, differing from FIG. 1, pushbuttons 16, 17. The finger-like element 14 is connected via a line 18 to the electronic control unit 8. Also to be seen is the opening region of the bypass line 7 on the life jacket 3 and the outlet region 19 for the air located in the life jacket 3. The electronic control unit 8 is supplied with energy via a battery 20.

The diving operation using the counterbalancing device and pushbuttons 16, 17 instead of the potentiometer 10 to a water depth of 10 meters is explained with the aid of an example.

The diver 1, equipped with the counterbalancing device 8, compressed air tank 2 and other necessary items fills the life jacket 3 with air before the diving operation. He jumps into the water and swims on the surface, since the, jacket 3 filled with air produces positive buoyancy. The diver 1 operates the pushbutton 17 (diving) and holds it pressed down. Owing to this measure, the electronic control unit 8 receives an electrical signal and opens the outlet valve 9', and air escapes from the jacket 3. Operation of descent begins.

The water pressure on the jacket 3 increases in proportion to the water depth and compresses the Jacket 3, as a result of which the rate of descent is increased. The pressure sensor 11 measures the change in pressure over time and determines the rate of descent therefrom. The electronic control unit 8 compares the determined rate of descent (actual value)

with the permanently programmed rate of descent (desired value), and controls the inlet valve 9 in such a way that the jacket 3 is filled with air, and thus the positive buoyancy is increased or the rate of descent is decreased.

The diver 1 terminates operation of the pushbutton 17 (diving) at a depth of 10 meters, for example. Using the first value which the pressure sensor 11 measures after release of the pushbutton 17, the electronic control unit 8 determines the desired value for the instantaneous depth.

All the pressure values measured later are used as actual values. The electronic control unit 8 now compares the actual values with the desired value. If the diver 1 has, for example, achieved a depth of 13 meters, the electronic control unit 8 controls the inlet valve 9, and the jacket 3 is filled with air. The diver 1 ascends due to the positive buoyancy.

If the diver has achieved, for-example, a depth of 7 meters, the electronic control unit 8 controls the outlet valve 9', and air escapes from the Jacket 3 and the diver 1 descends. The diver 1 is held constantly at the depth of 10 meters.

In order to surface, the diver 1 operates the pushbutton 16 (surfacing) and holds it pressed down. The electronic control unit 8 receives a signal, the consequence of which is opening of the inlet valve 9. The jacket 3 fills with air, the surfacing operation beginning.

The water pressure is proportional to the water depth. During surfacing, the jacket 3 decompresses, as a result of which the rate of ascent increases. The change in pressure is measured over time by the pressure sensor 1, and the rate of ascent is determined therefrom. The electronic control unit 8 compares the determined rate of ascent (actual value) with the permanently programmed rate of ascent (desired value) and controls the outlet valve 9' in such a way that air escapes from the jacket 3, and thus the positive bouyancy or the rate of ascent is decreased.

Figure 3:
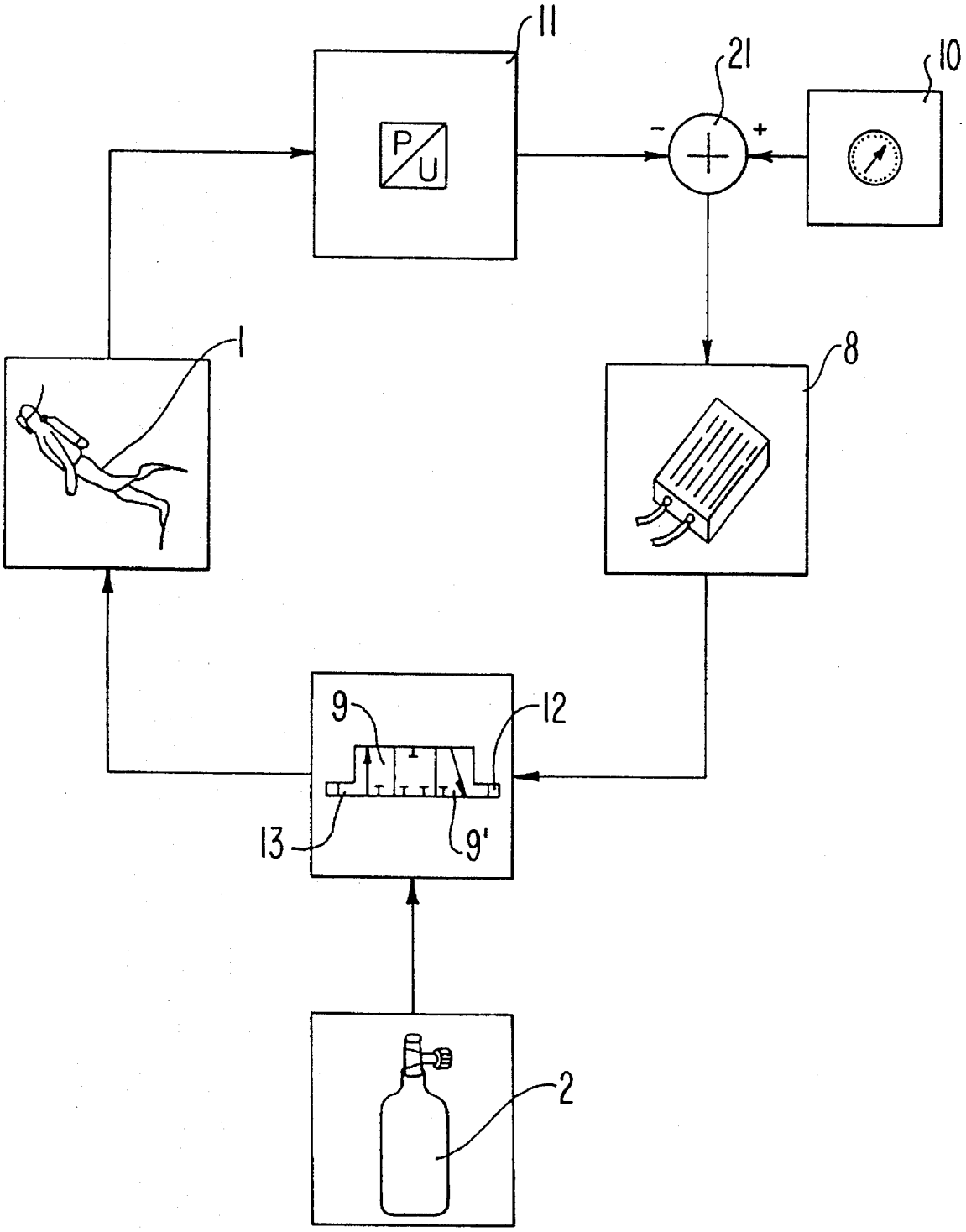
FIG. 3 shows a functional diagram of the diving operation using the counterbalancing device in accordance with FIGS. 1 and 2.

With the aid of a block diagram, FIG. 3 shows the diving operation using an automatic counterbalancing device in accordance with FIGS. 1 and 2 as well as with the preceding example. The operation of diving and surfacing is to be .once again explained in more detail, assuming that the diver 1 is located at a water depth of 10 meters.

The life jacket 3 of the diver 1 is filled with exactly enough air that the diver 1 floats at a water depth of 10 meters. The diver 1 decides to dive to a water depth of 13 meters, and therefore operates, in this example, the desired-value potentiometer 10 according to FIG. 1 in accordance with an electrical signal for the desired value S=13 meters of water depth. The summing point 21 is fed the instantaneous value of the depth S=10 meters, which is measured by the pressure sensor 11 and electrically converted, so that the electronic control unit 8 is signalled a difference of delta S=∓meters as an electronic signal. The circuit or the program of the electronic control unit 8 detects on the basis of the sign + of the system deviation delta S=∓ meters that the aim is to dive deeper by this distance, and controls the magnet 12 of the electropneumatic valve 9', which lets air out of the life jacket 3, so that the body descends together with the life jacket. The pressure sensor 11 continuously measures the water depth via the hydrostatic water pressure and, via the summing point 21, continuously compares the position with the position which has been preselected on the desired-value potentiometer 10. When the diver 1 achieves the position S=13 meters of water depth, the difference at the summing point is S=0 and the electronic control unit 8 does not further control the electropneumatic valve 9.

If the diver 1 descends deeper than S=13 meters during this operation of descent, for example to S=15 meters, the pressure sensor 11 measures this depth and converts the pressure into an electronic variable which is compared at the summing point 21 with the value, electronically set at the desired-value potentiometer 10, corresponding to S=13 meters, and determines a difference of delta S=–2 meters. On the basis of the sign, the electronic control unit 8 detects that it is now necessary for the other magnet 13 of the electropneumatic valve 9 to be controlled, and uses the valve 9 to release pneumatically the connection from the compressed air tank 2 to the life jacket 3, so that the volume of the life Jacket 3 increases and consequently the body ascends together with the life Jacket 3 up to S=13 meters. The value now measured and electrically converted by the pressure sensor 11 provides a difference of delta S=0 meters at the summing point 21, as a result of which the electronic control unit 8 does not further control the pneumatic valve 9, the pneumatic connection between the compressed air tank 2 and life jacket 3 being reclosed.

Superimposed on this position control loop by the circuit or the program in the electronic control unit 8 is a rate control loop in which, in the electronic control unit 8, the time is measured and the difference in depth measured by the pressure sensor 11 is computed mathematically with the time to form the rate of ascent and descent, the rate of descent resulting from V=delta S/delta T. This value is compared with a value prescribed in the electronic control unit 8 and in case the value is larger than the prescribed value, for example during descent, the electronic control unit 8 controls the electropneumatic valve 9' in such a way that air is led from the compressed air tank 2 into the life jacket 3, and for this reason the rate of descent decreases until the prescribed value is achieved and the electronic control unit no longer controls the magnet 12 or 13.

If, by contrast, the prescribed value of the rate of ascent is exceeded, air is let out of the jacket 3 in order to arrive at the desired value of the rate of ascent.

We claim:

1. A method for operating a counterbalancing device for a diver for automatically diving, surfacing or floating at a predetermined water depth, comprising:

setting the predetermined water depth on a control element;

measuring a water depth of the diver with a pressure sensor;

determining with the use of an electronic control unit one of a rate of descent and a rate of ascent based on a change of the measured water depth over time; and controlling, with the electronic control unit, at least one valve for one of filling air into and releasing air from at least one life jacket associated with the diver for controlling the diver's rate of ascent and descent, respectively, as a function of a difference between the determined rate of ascent or descent and a predetermined rate of ascent and descent, respectively, until the predetermined water depth is attained.

2. The method according to claim 1, said method further comprising controlling the rate of descent or ascent of the diver to be within a permissible range of the predetermined rate of ascent and descent, respectively.

3. The method according to claim 1, wherein the electronic control unit includes a switch for controlling the valve to fill and release air from the life jacket, said method further comprising:

operating the switch to control the ascent and descent in response to a position of the switch;

determining an associated water depth achieved by use of the switch;

storing the associated water depth as the predetermined water depth; and maintaining the diver at the predetermined water depth with said controlling step.

4. The method according to claim 3, said method further comprising superimposing the predetermined rate of ascent and descent on said operating step so that the ascent and descent achieved .by operating the switch is in accordance with the predetermined rate of ascent and descent, respectively.

5. The method according to claim 4, said method further comprising maintaining the superimposed rate control when the predetermined water depth is achieved.

6. The method according to claim 1, said method further comprising storing the predetermined rate of ascent and descent in the electronic control unit.

7. The method according to claim 1, said method further comprising turning the electronic control unit off if a difference between the predetermined water depth and the measured water depth does not decrease.

8. The method according to claim 1, said method further comprising displaying the predetermined water depth, the difference between the predetermined water depth and the measured water depth, the rate of descent, the rate of ascent, the measured water depth and an operating state of the electronic control unit on a display.

9. The method according to claim 1, said method further comprising monitoring a position of the at least one valve using a limit switch.

10. The method according to claim 1, said method further comprising:

monitoring the counterbalancing device for detecting cable breaks, failure of the pressure sensor and a low capacity of a power supply powering the counterbalancing device; and performing at least one of warning the diver and switching off the electronic control unit when at least one of a cable break, a pressure sensor failure and a low capacity of the power supply is detected.

11. The method according to claim 1, said method further comprising:

setting a maximum predetermined water depth; and locking the set maximum predetermined water depth for a predetermined period of time.

12. The method according to claim 1, said method further comprising:

performing a self test of all the functions of the electronic control unit; and displaying results of the self test on a display.

13. The method according to claim 1, said method further comprising initiating a surfacing operation of the electronic control unit when there occurs one of exceeding a permissible diving time, a threat of damage to health of the diver, and an insufficient quantity of air for continuing a dive.

14. A device for a diver for automatically diving, surfacing or floating at a predetermined water depth, the diver being supplied with breathing air and wearing at least one life jacket, said device comprising:

a valve pneumatically coupled to the life jacket for filling the life jacket with air or releasing air from the life jacket;

a pressure sensor for measuring water depth; and an electronic control unit connected to the pressure sensor and the valve for controlling the valve, in response to the measured water depth, for filling air into and releasing air from the at least one life jacket for controlling the diver's rate of ascent and descent to the predetermined depth.

15. The device according to claim 14, wherein the electronic control unit is adapted for being supported by one of the life jacket and a part of the diver's body.

16. The device according to claim 14, wherein the electronic control unit, the pressure sensor and the valve are adapted for being supported by one of the life jacket and a part of the diver's body.

17. The device according to claim 14, wherein the electronic control unit includes a microprocessor.

18. The device according to claim 14, wherein the electronic control unit includes analog components.

19. The device according to claim 14, wherein the valve functions in one of a continuous and discontinuous manner.

20. The device according to claim 14, wherein the valve comprises an electropneumatic pressure valve.

21. The device according to claim 14, wherein the valve comprises an electropneumatic directional valve.

22. The device according to claim 14, further comprising at least one limit switch operatively connected for monitoring of a position of the valve.

23. The device according to claim 14, wherein said electronic control unit includes a potentiometer for setting a predetermined water depth.

24. A method for a scuba diver to automatically dive, surface or float at a predetermined water depth, comprising utilizing the system according to claim 14.

25. The device according to claim 14, wherein said electric control unit includes means for setting the predetermined water depth and said electronic control unit controls the valve as a function of a difference between the predetermined water depth and the measured water depth.

26. The device according to claim 25, wherein said electronic control unit calculates an actual rate of ascent and descent from a change in the measured water depth over time and additionally controls the valve for controlling a rate of ascent or descent as a function of a difference between a predetermined rate of ascent and descent and the actual rate of ascent and descent, respectively, until the predetermined water depth is attained.

* * * * *